US010814512B2

(12) United States Patent
Warns

(10) Patent No.: US 10,814,512 B2
(45) Date of Patent: Oct. 27, 2020

(54) DEVICE FOR CUTTING FOODS

(71) Applicant: John Warns, Westfield, IN (US)

(72) Inventor: John Warns, Westfield, IN (US)

( * ) Notice: Subject to any disclaimer, the term of this patent is extended or adjusted under 35 U.S.C. 154(b) by 0 days.

(21) Appl. No.: 15/916,975

(22) Filed: Mar. 9, 2018

(65) Prior Publication Data

US 2019/0275690 A1 Sep. 12, 2019

(51) Int. Cl.

*B26D 1/553* (2006.01)
*B26D 7/10* (2006.01)
*B26D 3/18* (2006.01)

(52) U.S. Cl.

CPC ..... *B26D 1/553* (2013.01); *B26D 3/185* (2013.01); *B26D 7/10* (2013.01)

(58) Field of Classification Search

CPC ..... A21C 15/04; B26B 27/002; B26B 27/007; B26B 5/007; B26B 5/008; B26D 1/553; B26D 3/185; Y10T 83/9292; A63B 61/00–04

USPC ..... 30/114, 117

See application file for complete search history.

(56) References Cited

U.S. PATENT DOCUMENTS 1,111,373 A * 9/1914 Givulinovich ..... B26D 1/30 30/117
1,436,236 A * 11/1922 Cartuschka ..... A01J 23/00 30/117
1,526,126 A * 2/1925 Fitzherbert ..... A63B 61/02 473/493
1,598,404 A 8/1926 Tally
1,653,578 A * 12/1927 Larsen ..... B26D 1/553 30/117
2,130,045 A * 9/1938 Tapparo ..... B26D 1/547 83/542
2,158,667 A * 5/1939 Rieck ..... B26D 1/553 206/216
2,504,756 A * 4/1950 Tenborg ..... B26D 3/245 30/114
2,550,166 A * 4/1951 Sargent ..... B26B 27/002 30/117
2,679,688 A * 6/1954 Buschman ..... B26D 3/185 30/117
3,766,817 A * 10/1973 Aby ..... B26D 1/547 83/581.1
4,088,317 A * 5/1978 Gierla ..... A63B 61/00 242/532
4,195,402 A 4/1980 Leffer
4,213,241 A * 7/1980 Haapala ..... A21C 15/04 30/115
4,398,347 A * 8/1983 Duffy ..... B26B 27/002 30/90.1
4,425,706 A * 1/1984 Southworth ..... B26D 3/24 30/116
4,516,458 A * 5/1985 Pomerantz ..... B26D 1/26 30/116

(Continued)

*Primary Examiner* — Laura M Lee
(74) *Attorney, Agent, or Firm* — Woodard, Emhardt, Henry, Reeves & Wagner, LLP

(57) ABSTRACT

Among other things, there are disclosed embodiments of a cutting device for foods, having two opposed handles and a grid of filaments connected to them. In particular embodiments, a spindle within one handle allows the grid to be wound around it. The spindle may be biased, e.g. with a spring, and may include holding or braking mechanisms to hold the grid in a desired configuration.

15 Claims, 5 Drawing Sheets

(56) References Cited

U.S. PATENT DOCUMENTS 4,595,155 A * 6/1986 Gough ..... A63B 61/02 242/395.1
4,624,163 A * 11/1986 Grace ..... A23G 9/227 493/290
4,672,873 A * 6/1987 Kinser ..... B26D 1/547 83/200.1
4,993,719 A * 2/1991 Hernandez ..... A63B 61/02 273/298
5,153,993 A * 10/1992 Whisnant ..... A21C 5/00 30/116
6,647,848 B1 * 11/2003 Bruner ..... B26D 1/52 30/117
D584,368 S * 1/2009 Stoewhass ..... D21/705
8,087,443 B2 * 1/2012 Snyder ..... E01F 13/028 160/23.1
9,227,333 B2 * 1/2016 Marceau ..... B26B 27/002
9,352,477 B1 * 5/2016 Warnick ..... B26D 1/553
10,201,735 B2 * 2/2019 Goldberg ..... A63B 60/06
10,226,875 B2 * 3/2019 Newman ..... B26B 27/002
2003/0217471 A1 * 11/2003 Huang ..... B26B 29/00 30/312
2006/0100589 A1 5/2006 Lin
2010/0199500 A1 * 8/2010 Baeten ..... A21C 15/04 30/116
2010/0275792 A1 * 11/2010 Brown ..... B26D 3/185 99/538
2011/0030222 A1 * 2/2011 Chen ..... A21C 15/04 30/114
2014/0068949 A1 * 3/2014 Newman ..... B26B 27/002 30/114
2014/0360022 A1 * 12/2014 Marceau ..... A21C 15/04 30/114
2015/0000141 A1 * 1/2015 Owens ..... A21C 15/04 30/114
2015/0033924 A1 2/2015 Brown
2015/0197025 A1 * 7/2015 Spae ..... B26B 3/04 30/114
2019/0275690 A1 * 9/2019 Warns ..... B26D 7/10

* cited by examiner

DEVICE FOR CUTTING FOODS

The present disclosure concerns devices and methods for cutting foods, such as cakes or loaves, into several pieces. In particular, the present disclosure includes washable and retractable devices for easy division of foods, e.g. into uniform-size pieces.

BACKGROUND

It has been known to cut foods in various ways. An individual can cut a cake, loaf or other food using a standard knife, but unless the individual has exceptional hand-eye coordination, he or she will invariably cut pieces that are of various shapes or sizes. Using a knife can also generate pieces that are less aesthetically pleasing, as they drag along icing, crumbs or sections of a cake.

For uniformity of cutting pieces of a flat food, such as cake, a casserole or butter, proposals have been made for devices for cutting uniform pieces that use wires. Such items may be able to standardize piece size, but they can be unwieldy and difficult to use, clean and store. There remains a need for a device that is useful in cutting cakes or other foods into uniform, aesthetically pleasing pieces, that resolves issues with prior devices.

SUMMARY

Among other things, there are disclosed embodiments of a cutting device. For example, a cutting device may include a first handle having a first base portion and a second handle having a second base portion. The second base portion may have first and second ends and a side surface, as well as an interior chamber defined by a wall and having a longitudinal slot in the side surface. A network of filaments is connected to the first and second handles, the network having a plurality of lengthwise filaments. Each of the lengthwise filaments have respective first ends fixed to the first handle and respective second ends connected to the second handle. In particular embodiments, the device has a first retracted condition in which the first and second handles are adjacent or abutting each other and more than half of the network of filaments is within the chamber, and a second extended condition in which the first and second handles are separated from each other and the network of filaments extends out through the slot. The network of filaments can also include a plurality of crosswise filaments, with each of the crosswise filaments engaging each of the lengthwise filaments at respective points. In particular embodiments, at least one of such crosswise filaments is outside of the chamber between the first and second handles in the extended condition. The crosswise filaments may be each fixed to the lengthwise filaments at the respective points where they engage each other.

In certain embodiments, both handles may be similarly or identically structured, e.g. the base portion of the first handle may have an interior chamber defined by a wall, so that at least a portion of the network may be retracted into the interior chamber of the base portion of the first handle as well as into the base portion of the second handle. At least one of the bases of the handles can include at least one external retainer (e.g. magnet(s), hook-and-eye material) adapted to hold the bases together. A spindle may be fitted within the chamber of one of the handles, with the spindle being rotatable within the chamber and the network of filaments connected to the spindle. In the retracted condition, at least part of the network may be wrapped around the spindle. In certain embodiments, a spring may be operationally connected to the spindle. For example, such a spring may bias the spindle toward retracting the network into the interior chamber of the handle. In certain embodiments, a holding mechanism (e.g. a clutch, ratchet mechanism and/or friction brake) may be operatively connected to the spindle. The holding mechanism can selectively prevent turning of the spindle in a direction that retracts the network into the interior chamber of the handle, in one example. In certain embodiments, a turnable crank may be operatively connected to the spindle and external of the chamber, for turning the spindle in a desired direction.

Electrical components are also contemplated. For instance, a motor may be included, operatively connected to the spindle and/or network in particular embodiments. A battery or other power source may be operatively connected to the motor, so that the motor can be selectively energized by the battery to turn the spindle in at least one direction. Alternatively or in addition, a heating element may be operatively connected to at least part of the network in some embodiments. A battery or other power source operatively connected to the heating element allows the element to be selectively energized to apply heat to at least part of the network.

Embodiments of a cutting device including a first handle, a second handle having a side surface and a wall defining an interior chamber between first and second ends, and a grid of filaments is also disclosed. The grid is a network having a plurality of lengthwise filaments and a plurality of crosswise filaments, with each of the crosswise filaments fixed to each of the lengthwise filaments at discrete locations. Each of the lengthwise filaments have respective first ends fixed to the first handle and second ends extending into the interior chamber of the second handle. At least a portion of the grid is adapted to move into the interior chamber of the second handle for storage and to move out of the interior chamber of the second handle for use in cutting. A particular embodiment has an interior chamber of the second handle sized and configured to house enough of the grid so that the first and second handles abut each other with no part of the grid in slack between the handles. Features as summarized above and/or disclosed below may be included, such as a spindle within the interior chamber of the second handle to which the grid is attached and around which the grid can be wound. Embodiments are contemplated in which the grid and at least one of the handles are adapted to permit disassembly of the grid from the at least one handle without damage to the grid or the at least one handle, and/or where at least some of the discrete locations have the respective lengthwise filament and crosswise filament woven or twisted together.

Further embodiments and features are described further below.

DESCRIPTION OF THE ILLUSTRATED EMBODIMENTS

Figure 2:
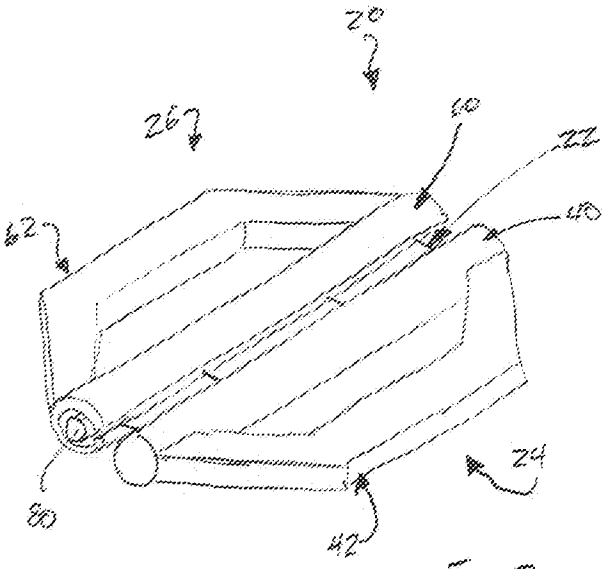
FIG. 2 is a perspective view of the embodiment of FIG. 1 in a generally closed or retracted condition.

To promote an understanding of the principles of the disclosure, reference will now be made to certain embodiments and specific language will be used to describe the same. It will nevertheless be understood that no limitation of the scope of the claims is thereby intended, such alterations and further modifications of the disclosed methods and/or devices, and such further applications of the principles of the disclosure as described herein, being contemplated as would normally occur to one skilled in the art to which the disclosure relates.

Referring now generally to the drawings, there is disclosed a cutter 20 for cutting foods into multiple pieces simultaneously, and particular embodiments of cutter 20 are designed for cutting sheet cakes. In the illustrated embodiment, cutter 20 includes a network of wires or filaments. As used herein, "network" means a configuration of multiple items associated with each other, and includes items 22 (shown as a grid) and 22' (shown as a set of parallel filaments). The network is connected to first and second handles 24, 26. As will be described further below, the network can be retracted into or otherwise stored in one or both handles 24, 26, and can extend between handles 24, 26, so that the user can hold handles 24, 26 and press the network through a cake or other food to cut it.

Grid 22 in particular embodiments is a rectangular (e.g. square) grid, having multiple lengthwise filaments 30 that are connected or attached to each of handles 24, 26, and multiple crosswise filaments 32. Filaments 30 and 32 define multiple internal spaces 33 between them, which in the illustrated embodiment are rectangular (e.g. square). By "filaments" is meant any type of elongated, sturdy, and at least semi-flexible line or cable capable of cutting at least soft foods such as cakes. In particular examples, filaments 30 and 32 are of the same material, for ease and convenience of manufacture. Materials can include metals, such as food-grade stainless steel, or synthetic materials, such as nylon, polyvinylidene fluoride (PVDF), or ultra-high molecular weight polyethylene, (UHMWPE), preferably those that can be easily cleaned manually or by machine without significant damage. A preferred embodiment of grid 22 includes filaments 30, 32 that are or include food-grade stainless steel wires, which can be rolled or folded without permanently changing the shape or configuration of grid 22, and which can be easily and quickly cleaned in hot water a retail or commercial dishwasher. In some embodiments, one or more filaments 30 and/or 32 may be serrated, or may have grit affixed to them, to make cutting stiffer icings or other harder foods easier.

In the illustrated embodiment, grid 22 includes four lengthwise filaments 30, all of which are parallel to each other along a longitudinal axis A. The outermost two filaments 30 form a border or perimeter, i.e. the outermost extent of grid 22 measured perpendicular to axis A. The distance between adjacent filaments 30, denoted by D, is constant in this embodiment. It will be understood that in other embodiments an alternative number of lengthwise filaments 30 may be used, such as 3, 5 or 6. The number of lengthwise filaments 30 will depend on the overall size of cutter 20 and the size of the pieces cutter 20 is intended to make. Grid 22 can be made specifically for a particular size of cake or other food or pan. For example, grids 22 can be made for a full sheet cake (16 inches by 24 inches), a half-sheet (12 inches by 16 inches) or a quarter-sheet (8 inches by 12 inches). In the full-sheet example, the outermost lengthwise filaments 30 may be separated by at least the 16-inch width of a full sheet cake. In other embodiments the outermost lengthwise filaments 30 may be separated by less than the full width of a cake or other food (e.g. less than the 16-inch width of a full-sheet cake). As one example, where lengthwise filaments 30 are separated by constant distance D, the outermost filaments 30 may be at least approximately the same distance D from the side edges of the cake, so as to provide substantially equal-sized pieces. It will also be understood that the overall size of grid 22 may be at least slightly larger than any of those sizes so that the user need not be exact in his or her placement and use of grid 22 with respect to a particular cake or other food.

The illustrated embodiment of grid 22 includes three crosswise filaments 32, all of which are parallel to each other and perpendicular to axis A and to each lengthwise filament 30. Filaments 32 are also parallel to each of handles 24, 26 in this embodiment, and handles 24, 26 can be thought of as a border or perimeter, or part of the overall border or perimeter of a cutting area along with the outermost filaments 30. It will be understood that in other embodiments an alternative number of crosswise filaments 32 may be used, such as 4, 5, 6, 7 or 8. The number of crosswise filaments 32 (and of lengthwise filaments 30) will depend on the overall size of cutter 20, and the size of the pieces cutter 20 is intended to make. For example, if cutter 20 is intended for use with a full-sheet cake (16 inches by 24 inches), and 2-inch by 2-inch pieces are desired, then at least seven lengthwise filaments 30 are provided (with the outermost two filaments 30 intended to be placed two inches in from the sides of the cake during cutting) and at least eleven crosswise filaments 32 between handles 24, 26 (with the outermost two filaments 32 intended to be placed two inches in from the ends of the cake and the handles 24, 26 clear of the ends of the cake during cutting).

Each filament 30 is fixed to each filament 32 at a respective point or location (shown in one example by P in FIG. 1) in the illustrated embodiment. The crosswise filaments 32 may alternately weave over and under lengthwise filaments 30, and/or the lengthwise filaments 30 may alternately weave over and under crosswise filaments 32. The respective filaments may be fixed to each other by any method suitable for use in a food environment, and preferably suitable for maintaining fixation over time, particularly in light of washing in hot water. In one example, filaments 30 and 32 are welded to each other by application of heat, while in other examples adhesives or mechanical connections may be used, and/or filaments may be twisted together or otherwise interengaged. In cases where filaments 30, 32 are cables (e.g. braided wires or similar elements), the elements of the respective cables may be woven together. As another example, individual filaments 30 and/or 32 may include evenly-spaced holes through which crossing filaments can be threaded, and in some such embodiments the interengaged filaments can be welded or otherwise fixed together. Grid 22 can be made with some or all filaments 30, 32 unfixed or able to float with respect to each other, as stretching of filaments 30 and/or 32 to a taut condition can maintain orientational spacing of the filaments 30 and/or 32 in rectangles or other desired shapes. Specific embodiments fix the filaments with respect to each other so as to maintain a consistent shape of grid 22, providing consistency in shape and size of spaces 33 defined by filaments 30 and 32 and pieces of a consistent shape and size when cutter 20 is used.

Handle 24 includes a base 40 and a grip 42 in this embodiment. Base 40 has a length L that is at least slightly longer than the distance between the outermost lengthwise filaments 30 in this embodiment. While shown as a cylinder in the illustrated embodiment, with an outer rounded side surface 44 between circular or oval end surfaces 46, 48, other shapes such as a rectangular or other polygonal solid may be used. On one side of base 40 in the illustrated embodiment is a series of openings 50 to or through which filaments 30 are connected to base 40. In such embodiments, each respective filament 30 passes through a respective hole 50 and is fixed to base 40. For example, each filament 30 may be knotted or include a bead at an end so that it cannot pass back through its respective hole 50, or may be fixed to an inside surface of base 40 (adjacent to holes 50 or across an inner volume of base 40), as by welding, adhesive or other methods. If base 40 is solid (i.e. does not include an internal chamber) and/or does not include holes 50, filaments 30 may be joined or fixed to or within the material of base 40, either directly or by adhesives, mechanical parts (e.g. eyebolts) or other methods.

Fixed to surface 44 away from openings 50 is grip 42. The illustrated embodiment shows grip 42 opposite (i.e. spaced 180 degrees around from) openings 50, but it will be understood that grip 42 may be spaced between 90 and 180 degrees around from openings 50. Grip 42 is formed with a center holding or gripping piece or surface 52 and legs or side pieces 54 that join to holding piece 52 at one end and to base 40 at the other. In the illustrated embodiment, grip 42 and base 40 together have the general shape of a trapezoid with a central space or opening 56. Particular examples of base 40 and/or grip 42 may be solid, or may be hollow. Handle 24 is made of a sturdy material, and preferably one that is washable in a retail or commercial dishwasher, such as hard plastics or stainless steel. Wood may also be used. Tacky or friction-enhancing materials or surfaces, such as natural or synthetic rubber, or protrusions or knurling, may be used or added to handle 24 (and particularly grip 42) so as to make it easier for a user to hold and manipulate handle 24.

Handle 26 has the same basic structure as handle 24, with a base 60 and a grip 62. Base 60 is outwardly similar or identical to base 40 in the illustrated embodiment, with the same or similar dimensions. Base 60 is hollow in this embodiment, defining a chamber 63 surrounded by a wall 64 and extending between ends 66 and 68, and includes an elongated slot 70 in surface 72 that is parallel to the central axis of base 60. Slot 70 is placed in the same relative location with respect to base 60 as openings 50 are with respect to base 40. Slot 70 extends along the entire length of base 60 in the illustrated embodiment, and preferably has a length that is at least slightly larger than the distance between the outermost lengthwise filaments 30 of grid 22, and a width that is at least slightly larger than the largest thickness of grid 22. Grip 62 in this embodiment is identical to grip 42, and may have features as described above. Grip 62 is placed opposite (i.e. 180 degrees around from) slot 70 in a particular example. As with grip 42, grip 62 may be placed in any of a variety of positions on base 60 with respect to slot 70, e.g. from 90 to 180 degrees around from slot 70.

Figure 5:
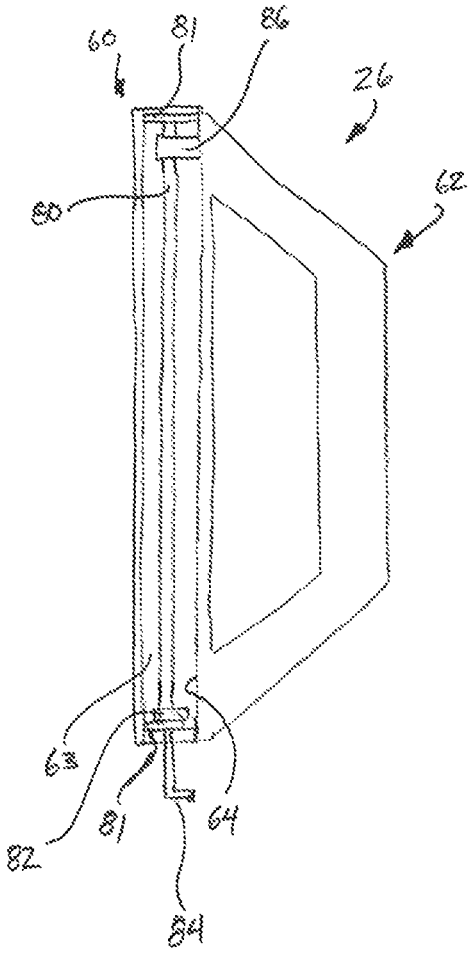
FIG. 5 is a part cross-sectional view of an embodiment of a handle portion usable in the cutting device of FIG. 1.

In the illustrated embodiment, within chamber 63 of base 60 is a rod or spindle 80, which in particular embodiments is a cylinder rotatably connected to ends 66, 68 as by brackets or races 81. Grid 22 is fixed at one end to spindle 80, e.g. each lengthwise filament 30 is fixed to or with respect to spindle 80 at a respective spaced location, so that grid 22 can wrap around spindle 80. Chamber 63 has a diameter in the illustrated embodiment that allows enough of grid 22 to wrap around spindle 80 so that bases 40 and 60 of handles 24, 26 may come together and touch without grid 22 being in slack between bases 40 and 60 (e.g. FIG. 2). Spindle 80 may be biased, e.g. by coil spring 82, toward a rolled-up condition, so as to pull grid 22 into chamber 63 and around spindle 80. Grid 22 may be pulled against the bias of spring 82, and through slot 70 by separating handles 24 and 26. In particular embodiments (see FIG. 5), a crank handle 84 is connected to spindle 80 to allow a user to wind and/or unwind spindle 80 and grid 22, especially in embodiments of cutter 20 without spring 82. In particular embodiments, a ratchet, gripping or similar mechanism 86 (indicated schematically in FIG. 5) may be attached or connected to spindle 80 to hold spindle 80 when grid 22 is extended partly and/or fully. For example, mechanism 86 may be or include a ratchet and pawl mechanism, friction brake, clutch or similar mechanism to hold spindle 80 and/or grid 22 when extended (as discussed further below) and to allow it to be retracted when the user desires. It is contemplated to place appropriate seals around spring 82, mechanism 86, and/or rotation points of spindle 80 (or between one or more of them and filament(s) 30 and/or 32) so as to separate such mechanical portions from water, food or other items that may damage or impair their function.

As previously indicated, grid 22 is fixed at one end to base 40 of handle 24, e.g. with respective filaments 30 engaged in or through respective holes 50 or otherwise to base 40. In some embodiments filaments 30 do not move into or out of base 40. Grid 22 is fixed at the other end to base 60 of handle 26, or through slot 70 to spindle 80 within base 60. Crosswise filaments 32 cross and are fixed to lengthwise filaments 30, as discussed above. Crosswise filaments 32 do not extend beyond their fixation point with the outermost lengthwise filaments 30, so that a smooth perimeter of grid 22 is presented. In that embodiment, there is less risk of catching edges of grid 22 on an individual, fabric, the sides of a dish or otherwise damaging adjacent items.

Figure 3A:
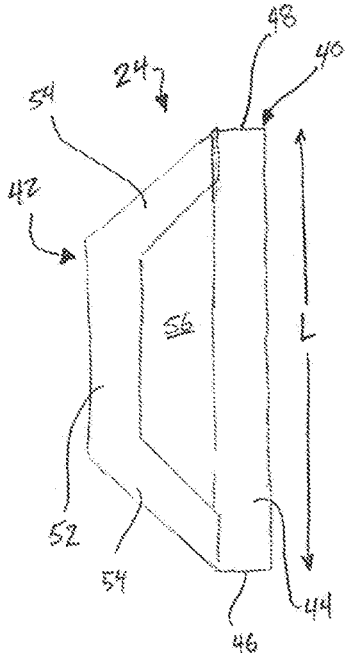
FIG. 3A is a top plan view of an embodiment of a handle portion usable in the cutting device of FIG. 1.
Figure 3B:
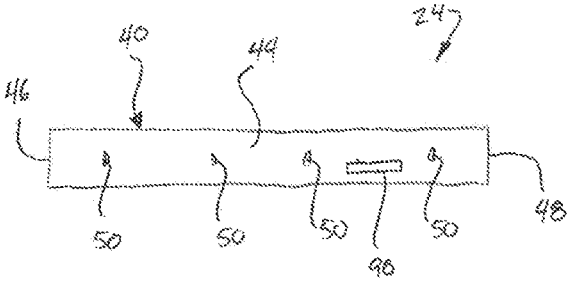
FIG. 3B is a side elevational view of the embodiment of FIG. 3A.
Figure 4A:
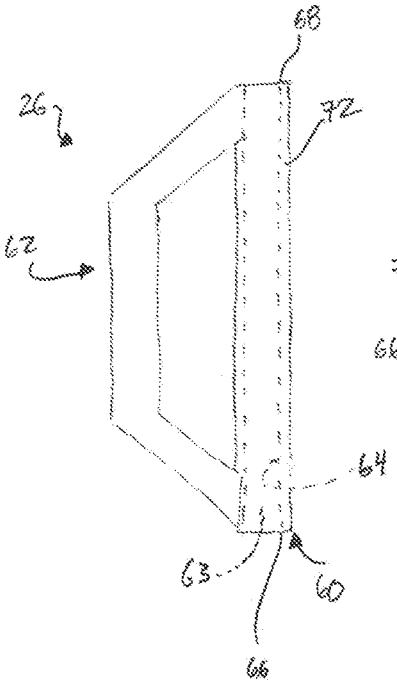
FIG. 4A is a top plan view of an embodiment of a handle portion usable in the cutting device of FIG. 1.
Figure 4B:
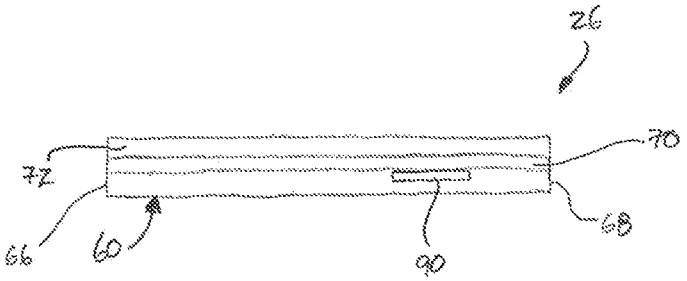
FIG. 4B is a side elevational view of the embodiment of FIG. 4A.

In particular embodiments, handles 24, 26 may be fitted with structure to connect or hold the handles 24, 26 together when cutter 20 is in storage or not in use. Such connectors or holders are indicated schematically at 90 in FIGS. 3B and 4B. For example, each handle 24, 26 may have a respective magnet fixed to it (e.g. to side 44 and the outer surface of wall 64) of opposite polarities so that when handles 24, 26 are adjacent each other, the magnets will attract and hold handles 24, 26 together. As another example, one of handles 24, 26 may have a hook fixed to it, and the other an eyebolt, so that handles 24, 26 can be held together by inserting the hook through the eye of the eyebolt. Other types of connecting materials may be used, such as hook-and-eye material (e.g. VELCRO brand), clasps, snaps or the like.

Handles 24, 26 may be collapsible in particular embodiments for easier storage. For example, grip portion 42 may fold onto itself, or may be arranged to fit into at least part of base 40. In such embodiments, it will be understood that grip portion 42 may snap into or otherwise be held in a configuration for use (e.g. FIGS. 1, 3A, 4A) and may also be held in a folded or otherwise collapsed position.

Grid 22, or at least lengthwise filaments 30, may in particular embodiments be removable or releasable from one or both of handles 24, 26. In such embodiments, handle 24 and/or 26 may be disassembled from at least part of grid 22 for cleaning or replacement, and grid 22 (or a replacement) can be reassembled to handle 24 and/or 26 for further use. In embodiments in which grid 22 is attached to a support (e.g. spindle 80), the support may be removable from a handle (e.g. handle 26) for replacement or cleaning, as noted above.

Use of cutter 20 in a particular embodiment will now be described in the context of cutting a cake, e.g. a sheet cake. It will be understood that the techniques described below may be used in cutting any of a number of foods.

Figure 6:
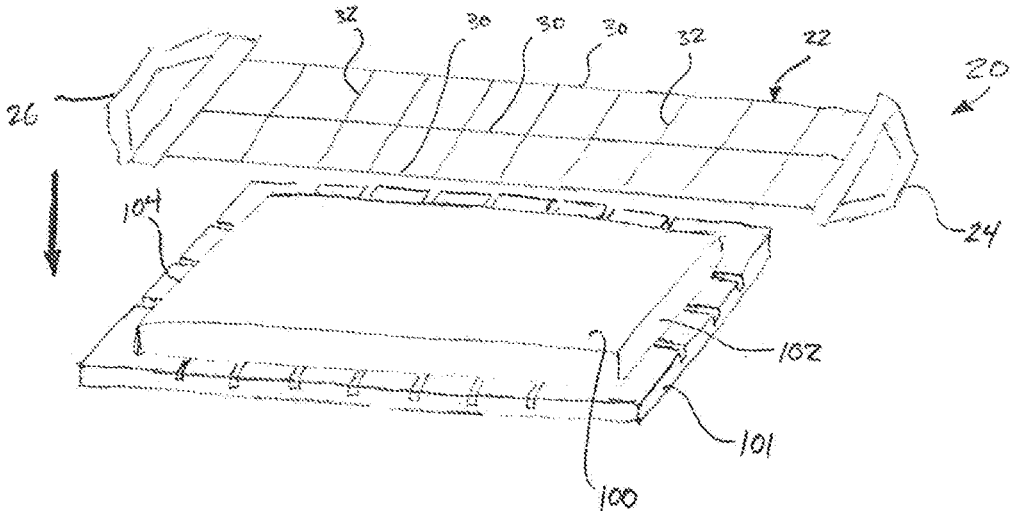
FIG. 6 is a perspective view of an embodiment of a cutting device in use with a cake.
Figure 7:
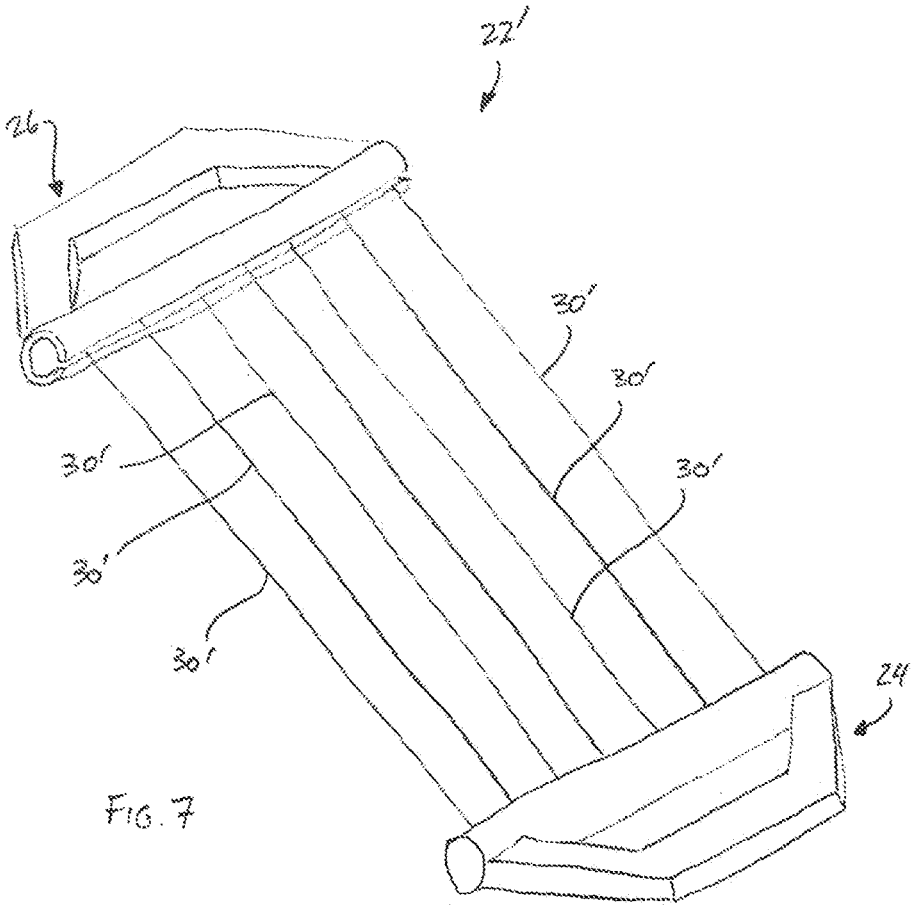
FIG. 7 is a perspective view of an embodiment of a cutting device in a generally open or extended condition.
Figure 8:
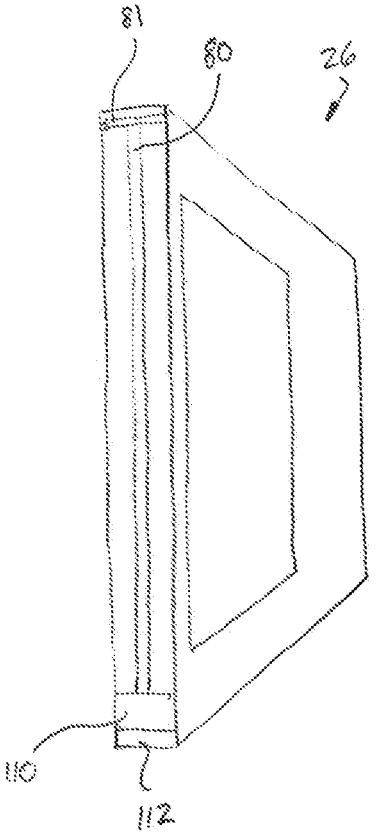
FIG. 8 is a part cross-sectional view of an embodiment of a handle portion usable in the cutting device of FIG. 1.
Figure 9:
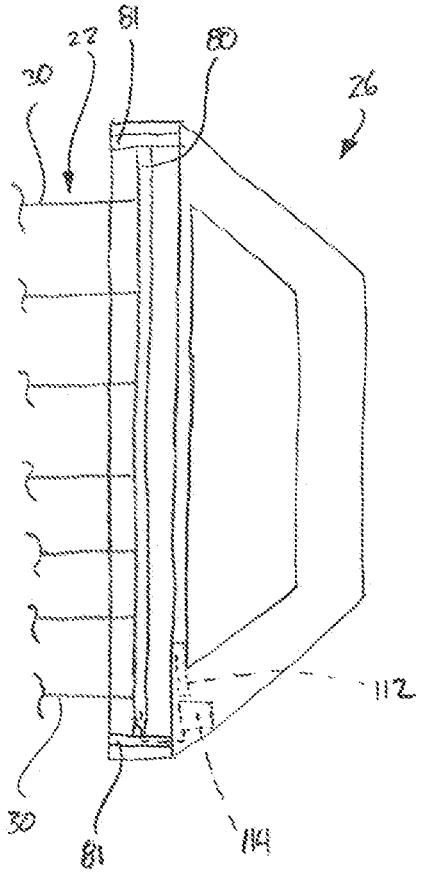
FIG. 9 is a part cross-sectional view of an embodiment of a handle portion usable in the cutting device of FIG. 1.

As seen in FIG. 6, a rectangular cake 100 is shown on a support 102, such as a plate, serving board, pan, sheet or similar platform 101. It will be understood that platform 101 may be specifically formed for and/or provided with cutter 20, e.g. with one or more grooves placed so as to accommodate one or more of filaments 30, 32 when cutter 20 is used. Cutter 20 is initially in a retracted or compact configuration, with handles 24, 26 adjacent or abutting each other (e.g. as in FIG. 2), and grid 22 being wound within handle 26 so that a minimal part of grid 22 is exposed.

Figure 1:
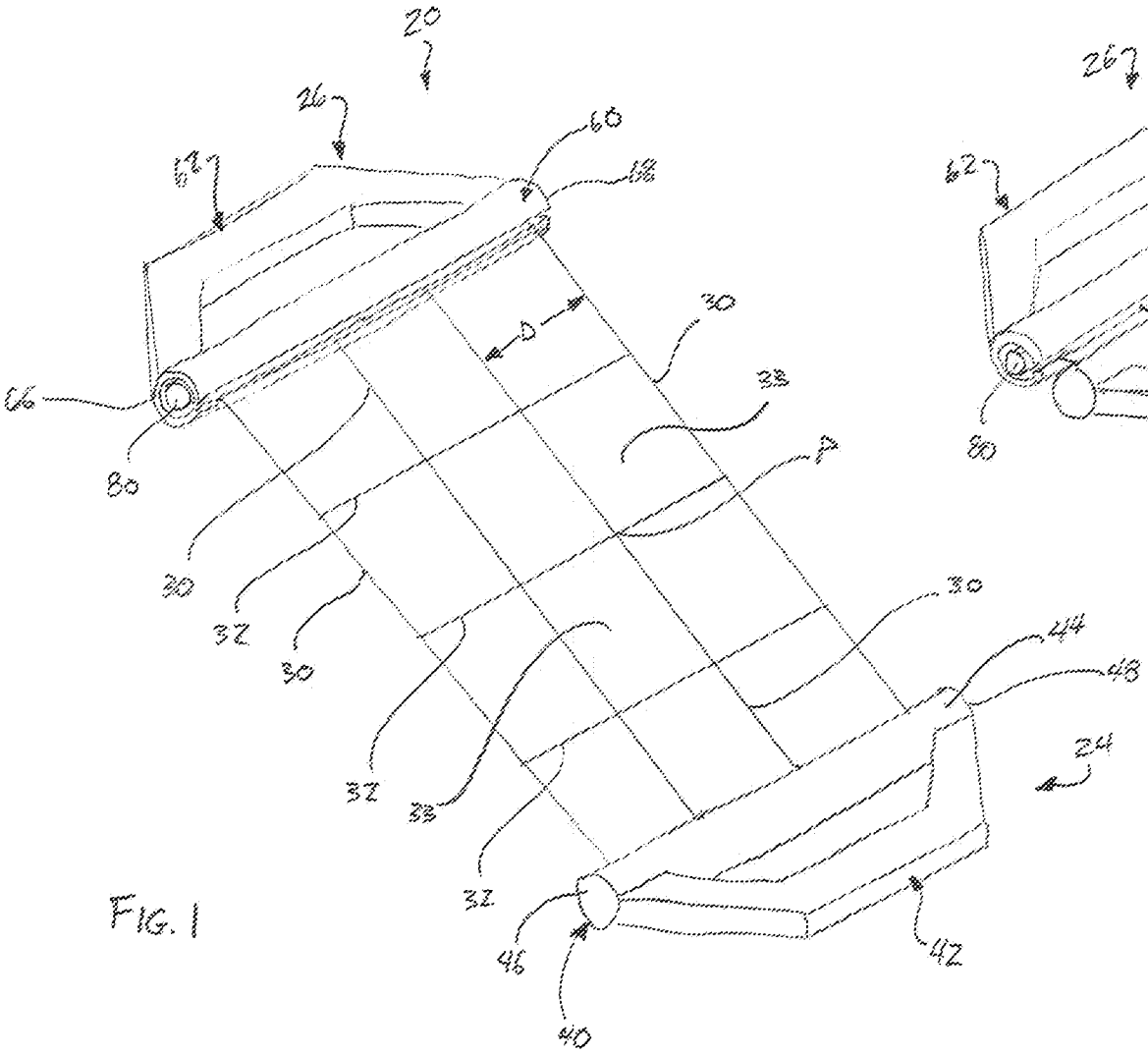
FIG. 1 is a perspective view of an embodiment of a cutting device in a generally open or extended condition.

When cutting of cake 100 is desired, a user takes cutter 20 in his or her hands, i.e. so that grips 42 and 62 of handles 24, 26 are in respective hands of the user. The user pulls handles 24, 26 apart, so that grid 22 is pulled through slot 70 and out of handle 26. Examples of such an extended configuration are seen in FIGS. 1 and 6. In embodiments having spindle 80, spindle 80 turns to pay out grid 22. As noted above, the turning of spindle 80 may be against a spring 82 or other bias. In embodiments having a stop or hold mechanism 86, the user may continue pulling to a desired point, i.e. until a desired amount of grid 22 is pulled out of handle 26, and allow mechanism 86 to hold grid 22 at that configuration. In these or other embodiments, handles 24, 26 may be pulled apart until the amount of exposed grid 22 will cover all or a portion of cake 100, until handles 24, 26 are apart a distance greater than a dimension of cake 100, or until grid 22 is entirely unwound or pulled through, so that grid 22 is taut between handles 24 and 26.

When grid 22 is exposed between handles 24, 26 as desired, the user moves cutter 20 over and toward a top surface of cake 100. For example, the user may place the sides of handles 24, 26 facing each other just outside the edges 102, 104 of cake 100. The user can, of course, orient cutter 20 with respect to cake 100 as he or she prefers, but FIG. 6 shows cutter 20 oriented so that filaments 30 are essentially perpendicular to edges 102, 104 of cake 100, and filaments 32 are essentially parallel to edges 102, 104. In this way, use of cutter 20 produces rectangular (e.g. square) pieces even at the edges of the cake.

When placed or oriented as desired, the user (holding handles 24, 26) moves cutter 20 down (in the direction of the arrow in FIG. 6), forcing grid 22 through cake 100. Preferably, the path of travel of grid 22 is substantially perpendicular to the top of cake 100 and/or the plate or board 101 on which cake 100 rests. Such a path makes it easier for the user to pull grid 22 back along the same path so as to avoid or minimize injury to the cut pieces. Filaments 30, 32 make cuts in cake 100 to separate it into pieces with minimal surface area engaging the cake, so that icing, crumbs or larger parts of the pieces are less likely to stick to filaments 30, 32.

Once grid 22 is through cake 100 to the greatest possible extent (e.g. through to the bottom of cake 100, and/or in at least partial engagement with board 101 or into groove(s) in it) or to another extent as the user may desire, the user pulls cutter 20 back through cake 100, preferably along the path used to press cutter 20 through the cake. If the entirety of cake 100 is not cut into desired pieces with a single use of cutter 20, the user may move cutter 20 to an uncut portion of cake 100, and perform again the actions noted above. Such a further cutting action may include orienting cutter 20 so that one or more respective filaments 30 and/or 32 are aligned with one or more respective previously-made cuts.

Following use, cutter 20 can be cleaned and stored. As noted above, grid 22 and handles 24, 26 are preferably of materials that are easily washed by hand or in a consumer or commercial dishwasher. Such materials may be or include stainless steel for grid 22, and stainless steel or food-grade durable hard plastics for handles 24, 26. Cutter 20 is preferably maintained in its expanded or extended configuration during washing, so that all of grid 22 used for cutting is exposed to the washing.

Once cleaned, cutter 20 is returned to its initial wound-up or retracted configuration. In embodiments in which spindle 80 is biased, holding mechanism 86 (if present) is released so as to allow the bias to turn spindle 80 and wind up grid 22 around it. For example, a pawl may be released, or a clutch or friction brake may be disengaged, to allow spring 82 to wind spindle 80 and grid 22. In embodiments in which spindle 80 is manually wound, as by external crank 84, the user turns crank 84 so as to wind grid 22 around spindle 80. Grid 22 moves back through slot 70 as it winds around spindle 80, bringing handles 24 and 26 toward each other. With handles 24 and 26 adjacent or abutting each other, and grid 22 wound around spindle 80, cutter 20 can be easily stored.

Alternative embodiments to those shown in the drawings and described above are contemplated. For example, a cutter 20' may have a network 22' of filaments that includes only lengthwise filaments 30', attached as discussed above to handles 24, 26. In such embodiments, cutter 20' cuts in only one direction (as in slicing a loaf of bread), and to cut pieces of a cake (as one example) would be used at least twice, e.g. once parallel to one side of a sheet cake and once perpendicular to that side of the cake.

Embodiments of handle 24 and/or 26 may include additional related tools, such as a knife, a sharpener and/or a server or spatula. Such tools may be folded into or along base 40, 60 of handle 24 and/or 26, and pivoted or otherwise drawn out when needed.

In particular embodiments, a network of filaments 22, 22' may be made of spring steel, so that it can extend from and retract into handle without a support (such as spindle 80). Further, although a particular example was given above showing a grid 22 extending from and retracting into only handle 26, it will be understood that in other embodiments grid 22 may be retractable into and extendable from both handles. For example, two handles 26 as described above (rather than handle 24 and 26) may be provided with grid 22. Features described above, such as spindle 80, spring 82 and holding mechanism 86, may be placed in either or both such handles. Other embodiments are contemplated in which grid 22 is not retractable into either handle, e.g. where two handles 24 as described above are provided with grid 22.

In other embodiments, in addition to or in place of a spring to retract grid 22, an electric motor 110 may be placed in a handle (e.g. handle 26, and operatively connected to spindle 80). The motor may be powered by a battery 112

(rechargeable or non-rechargeable). When retraction of grid 22 is desired, a switch is used to activate the motor, which turns spindle 80 and/or grid 22 to retract it into handle 26. Embodiments are also contemplated in which a battery 112 is provided to energize one or more of filaments 30, 32, or a heating element 114 contacting one or more of filaments 30, 32 and/or spindle 80, so as to heat such filament(s). Heating filament(s) can make it easier to cut certain foods, particularly refrigerated or frozen foods such as butter or ice cream. In embodiments using electrical devices such as motors, batteries or heating elements, it will be understood that appropriates seals will be placed around them so as to prevent or inhibit water, food or other items from damaging them or impairing their function.

While the subject matter herein has been illustrated and described in detail in the exemplary drawings and foregoing description, the same is to be considered as illustrative and not restrictive in character, it being understood that only the preferred embodiment(s) have been shown and described and that all changes and modifications that come within the spirit of the disclosure are desired to be protected. It will be understood that structures, methods or other features described particularly with one embodiment can be similarly used or incorporated in or with respect to other embodiments.

What is claimed is:

1. A device for cutting food into pieces, comprising:

a first handle having a first base portion;

a second handle having a second base portion, the second base portion having first and second ends and a side surface, the second base portion having an interior chamber defined by a wall and having a longitudinal slot in the side surface;

a network of filaments configured for cutting food into pieces connected to the first and second handles, the network having a plurality of lengthwise filaments, each of the lengthwise filaments having respective first ends fixed to the first handle and respective second ends connected to the second handle, and the network also having a plurality of crosswise filaments, each of the crosswise filaments engaging each of the lengthwise filaments at respective points, wherein the device has a first retracted condition in which the first and second handles are adjacent each other and more than half of the network is within the chamber, and a second extended condition in which the first and second handles are separated from each other and the network extends out through the slot, wherein at least one of the crosswise filaments is outside of the chamber between the first and second handles in the extended condition, and wherein the first base portion of the first handle has an interior chamber defined by a wall, whereby at least a portion of the network may be retracted into the interior chamber of the first base portion.

2. The device of claim 1, wherein the crosswise filaments are each fixed to the lengthwise filaments at the respective points where they engage each other.

3. The device of claim 1, wherein at least one of the first base and the second base includes at least one external retainer adapted to hold the first base and the second base together.

4. The device of claim 1, further comprising a spindle within the chamber of the second handle, the spindle being rotatable within the chamber, and wherein the network is connected to the spindle so that in the retracted condition at least part of the network is wrapped around the spindle.

5. The device of claim 4, further comprising a spring operationally connected to the spindle, the spring biasing the spindle toward retracting the network into the interior chamber of the second base portion of the second handle.

6. The device of claim 4, further comprising a holding mechanism from the group consisting of a clutch, ratchet mechanism and friction brake, the holding mechanism operatively connected to the spindle so as to selectively prevent turning of the spindle in a direction that retracts the grid into the interior chamber of the second base portion of the second handle.

7. The device of claim 4, further comprising a turnable crank operatively connected to the spindle and external of the chamber, the turnable crank adapted to being turned to turn the spindle in a desired direction.

8. The device of claim 4, further comprising a motor operatively connected to the spindle and a battery operatively connected to the motor, whereby the motor is selectively energizable by the battery to turn the spindle in at least one direction.

9. The device of claim 1, further comprising a heating element operatively connected to at least part of the network and a battery operatively connected to the heating element, whereby the heating element is selectively energizable by the battery to apply heat to at least part of the network.

10. A device for cutting food into pieces, comprising:

a first handle;

a second handle having a side surface and a wall defining an interior chamber between first and second ends of the second handle;

a grid having a plurality of lengthwise filaments and a plurality of crosswise filaments configured for cutting food into pieces, each of the crosswise filaments fixed to each of the lengthwise filaments at discrete locations; a spindle within the interior chamber of the second handle to which the grid is attached and around which the grid can be wound, wherein each of the lengthwise segments have respective first ends fixed to the first handle and second ends extending into the interior chamber of the second handle, and wherein at least a portion of the grid is adapted to move into the interior chamber of the second handle for storage and to move out of the interior chamber of the second handle for use in cutting.

11. The device of claim 10, wherein the grid and at least one of the handles are adapted to permit disassembly of the grid from the at least one handle without damage to the grid or the at least one handle, whereby the grid or the at least one handle may be cleaned or replaced.

12. The device of claim 10, wherein at at least some of the discrete locations, the respective lengthwise filament and crosswise filament are woven or twisted together.

13. The device of claim 1, wherein the filaments are of materials suitable for contacting food.

14. The device of claim 1, wherein the device is cleanable in a dishwasher.

15. The device of claim 1, wherein at least one of the filaments is releasable from one or both of the first and second handles, whereby the at least one filament can be replaced or cleaned.

* * * * *